United States Patent [19]

Petrovich

[11] 3,930,997

[45] Jan. 6, 1976

[54] UNIVALENT METAL DOUBLE CYANIDE AS REDUCING AGENTS IN FROTH FLOTATION OF MINERAL

[76] Inventor: Vojislav Petrovich, 1925 W. Schiller St., Chicago, Ill. 60622

[22] Filed: Apr. 30, 1974

[21] Appl. No.: 465,409

[52] U.S. Cl. ..... 209/166
[51] Int. Cl.[2] ..... B03D 1/02
[58] Field of Search ..... 209/166, 167

[56] References Cited

UNITED STATES PATENTS

| | | | |
|---|---|---|---|
| 1,628,046 | 5/1927 | Herman | 209/166 |
| 3,382,976 | 5/1968 | Mercade | 209/167 |

FOREIGN PATENTS OR APPLICATIONS

| | | | |
|---|---|---|---|
| 354,395 | 8/1931 | United Kingdom | 209/166 |
| 362,961 | 12/1931 | United Kingdom | 209/166 |
| 495,909 | 11/1938 | United Kingdom | 209/166 |

*Primary Examiner*—Robert Halper

[57] ABSTRACT

An improved method in concentration of oxide ores and minerals by froth flotation process which comprises subjecting a pulp of mineral slurry of an oxide ore or mineral of metal which can change the valency state from higher to lower by the action of reducing agent consisting of univalent metal double cyanide, which as strong reducing agent change the valency state from higher to lower of the metal at the mineral surface, thus rendering the mineral particle to be capable to activate the double & triple carbon to carbon bond of certain collector possessing this bond such as olefine alcohols or propargyl carbinals. The indicated compounds provide recovery of oxide minerals of manganese, tin, titanium, thorium, tungsten, vanadium, and samarium.

1 Claim, No Drawings

UNIVALENT METAL DOUBLE CYANIDE AS REDUCING AGENTS IN FROTH FLOTATION OF MINERAL

BRIEF SUMMARY OF THE INVENTION

This invention relates to a reducing method in the mineral slurry by introducing in the same, univalent metal double cyanides, which act as powerful reducing agents, which change the metal valency state of the metal at the mineral surface, rendering the metal at the mineral surface or a portion of the mineral surface to a lower oxidizing state, which state is chemically a very active one especially against double or triple carbon to carbon bonds. Thus, the involved lower oxidizing state of the respective metal at the mineral surface presumably activates the triple and the double carbon to carbon bond of a given collector, effecting in this way a successful flotation of the desired metal values from the mineral slurry. Among such ores and minerals, to the beneficiation of which this invention is particularly adapted are the dioxides of manganese, tin, titanium, thorium, tungsten, vanadium, and samarium minerals.

According to the use of such powerful activators with reducing activity as are the univalent metal double cyanides the minerals of metals at their higher or highest valency level, which is the most natural occurence for these metals, as are minerals manganese, tin, titanium, thorium, tungsten, vanadium, and samarium, are amenable to froth flotation with reducing activation following the collection with olefine alcohols, or propargyl carbinols or as collectors. Accordingly, the metal such as tin, titanium thorium and vanadium which are refractory to activate with oxidizing agents are amenable to reducing activation and froth flotation with the said collectors.

Furthermore, the reducing activation of certain minerals make feasible the selective separation of such minerals as are: ilmenite from zircon, ilmenite from magnetite, ilmenite from niobate-tantalate.

Stated more particularly I have discovered that univalent metal double cyanides of the formula:

| | |
|---|---|
| di-Potassium manganese tricyanide | $K_2Mn(CN)_3$ |
| di-Potassium iron tricyanide | $K_2Fe(CN)_3$ |
| di-Potassium nickel tricyanide | $K_2Ni(CN)_3$ |

are powerful reducing agents suitable for reducing activity in the pulp of mineral slurry. If the metal which is a consisting ingredient of a given mineral, which can change the valency state at the mineral surface of the treated mineral slurry from a higher valency state to a lower by the action of manganese, iron, and nickel dipotassium tricyanides, the acquired lower valency state of a given metal at the mineral surface will function by it side as reducing agent against the collector with a double or triple carbon to carbon bond, thus forming a mineral-hydrocarbon-air complex at the surface of a bubble. The mineralized bubbles unite to a coherent froth.

Thus this invention teaches the use of univalent metal double cyanides of iron, manganese, and nickel, which act as powerful reducing agents, and not as cyanides. After the reducing action is accomplished oxidized metal dipotassium tricyanides exist in the pulp of the mineral slurry. However, it should be noted that this invention is not based on their action as cyanides. In order to oxidize the metal tricyanides an adequate excess of potassium cyanide is maintained in the pulp of mineral slurry and sulfuric acid is added so that the cyanide ion is sufficiently liberated to combine with the metal in the tricyanide. Note, that the manganese, iron, and nickel are bound only with one valency bond; being in the lowest valency state, manganese, iron, and nickel by its very nature are avid of bonding, i.e., reducing, because the manganese can acquire the valency state of seven, iron of six, and nickel of four; thence the powerful reducing property of these univalent metal double cyanides, which property they exercise at the mineral surface for all metals which can acquire lower valency state, for a given metal which is reduced at the mineral surface is avid of bonding, i.e., reducing of a collector with a double or triple carbon to carbon bond. Thus, manganese, tin, titanium, thorium, tungsten, vanadium, and samarium mineral particles if chemically reduced at the very surface are responsive to a collector with a double or triple carbon to carbon bond. In this behavior in the essence of this invention.

Collectors of the present invention which presumably function by the chemical reaction based on the activation of the double or triple carbon to carbon bond of an olefinic or acetylenic compound, i.e., the $\pi$-bond, by the action of a metal in a lower oxidation state formed at a portion of the surface of the mineral to be floated, forming with the metal atoms exposed on the surface of mineral particle presumably addition compounds.

The lower oxidizing state of a metal at the mineral surface, provoked by a strong inorganic reducing agent, is eager of bonding, i.e., of reducing. If for instance an oxidizing agent is added, the lower oxidizing state, i.e., the lower metal oxide will oxidize to higer, i.e., to the higher valency state in respective case to metal dioxide, the dioxide of manganese, dioxide of titanium, or dioxide of tin, as they were before the treatment with inorganic reducing agent. But with a collector with double or triple carbon to carbon bond no oxygen as electron carrier is introduced in the electron transfer reaction, but a potentially high valency state, so to speak, with ready disposable valency eager of bonding. Such an active state in a pulp of mineral slurry forces a new state of things resulting in compounding the disposable lower metal valency state of a lower oxide and hydrocarbon with frothing properties. The double or triple carbon to carbon bond of the collector is lost, because the disposable bond binds to metal, forming a kind of metal-organic compound. Thus olefinic or acetylenic compound act as an oxidizing agent by saturation of metal binding deficit to optimum valency by stretching the disposable $\pi$-bond, forming thus metal-organic compound. In such a kind of electron transfer reaction olefinic or acetylenic compounds of collectors of this invention becomes a saturated hydrocarbon, which having the froting properties effect the froth flotation of said minerals from their ores.

Such action in the operation of froth flotation of a mineral slurry is feasible because of high oxidation-reduction potential of said dipotassium unipositive metal tricyanides which are as follows:

| | | | |
|---|---|---|---|
| System | $K_2/Mn(CN)_3/$ | $K_2/Mn(CN)_4$ | $E_h - 0.950$ v |
| System | $K_2/Fe(CN)_3/$ | $K_2Fe(CN)_4$ | $E_h - 0.922$ v |
| System | $K_2/Ni(CN)_3/$ | $K_2/Ni(CN)_4$ | $E_h - 0.889$ v |

Compounds with a double carbon to carbon bond have an oxidation-reduction potential of −0.52 v.

Compounds with a triple carbon to carbon bond have an oxidation-reduction potential of −0.73 v .

Both unsaturated hydrocarbons act as oxidizing agents being reduced to simple carbon to carbon bond, losing at the same time its electromotive force. Thus, oxidation-reduction reaction in modern meaning has no more exclusive connection with augmenting or lowering of oxygen in oxidation-reduction reaction, for olefinic, as well as acetylenic compounds as is in the respective case of this invention are electron acceptor, therefore acting as oxidizing agents. Against a high electronegative potential they will act as electron donor acting thus as reducing agents.

The investigations have shown that various ores and minerals of the aforesaid metals in complex mineral occurrences respond to the reducing process of my invention, providing an improved and simplified flotation process.

Thus, the object of this invention is to provide an improved process of beneficiating or concentrating oxide ores and minerals.

Another object of this invention is a beneficiation process effective economically to recover the heretofore said metallic values primarely from silica and silicate gangue minerals.

A still further object of this invention is to subject oxide ores to froth flotation, thus collecting a concentrate having improved sales appeal both as to grade and purity.

Still further objects of this invention will be apparent upon a complete understanding of the invention as hereinafter more fully described.

The collectors used in this invention presumably function by the chemical reaction based on the activation of the double or triple carbon to carbon bond, by the action of the lower valency state of the metal at the mineral surface, or portion of the mineral surface, which is provoked by the action of the powerful reducing univalent metal tricyanides, thus forming addition compounds of metal-hydrocarbon-air complexes. It is obvious that the rest of hydrocarbon compound is oriented outward from the said mineral particle, thus the attachment of the collector to the ore particle form a water repellent surface or barrier around at least a part of the surface of the ore particle and thereby facilitates the formation of froth when the ore slurry is agitated in the presence of air.

The collectors useful in recovering minerals of this invention are: olefine alcohols and propargyl carbinols, both series of collectors having 5 to 15 carbon atoms. Being alcohols these collectors have pronounced frothing properties.

The flotation plant practice applying the inventor's method by serving the reducing principle in recovering of metal value, i.e., reducing the metal at the mineral surface to a lower valency state by the action of univalent metal tricyanide, and floating the mineral value with olefine alcohols or propargyl carbinols, the ore is crushed, milled and sized to at least about 80 to 120 mesh standard sieve, which depends on the particular ore treated. Milling to finer sizes is preferable. The crushed and sized ore is pulped and as a mineral slurry is ready for treatment in the flotation equipment, i.e., by passing through the conditioner for the treatment with reducing agent such as univalent metal double cyanide. From the conditioner the pulp is pumped in the receiving box of the first stage or the main flotation bank. In the receiving box of the pump beneath the conditioner, the collector is added, such as olefine alcohols or propargyl carbinols. In the main flotation bank, i.e., the first stage, the froth produced by agitation and aeration is skimmed or is overflowing in the usual manner.

It is preferable to operate the flotation with fresh water after conditioning in a reducing media, thus cycloning the reduced mineral slurry followed by addition of fresh water is preferable. After reducing of the mineral surface is accomplished the collector and auxiliary agents, if any are to be used, are added for further treatment in the flotation equipment. In the flotation cell the ore pulp is contacted with air by agitation to form a froth to achieve the desired separation of the metal values from the gangue. In most cases it is advantageous to use multiple stage flotation process to treat the underflow or partially metal value barren pulp to increase the degree of separation or to enhance the grade of recovery. Also, the use of varying amounts of emulsifiers, dispersants, and depressants etc. in different stages may be used to advantage to obtain the highest yield and best separation.

Having disclosed the novel reducing agents of this invention as well as the handling of the mineral slurry, I have to say the final object of this invention is to provide a method for the flotation recovery of minerals containing manganese, tin, titanium, thorium, tungsten, vanadium, and samarium.

The above discussion illustrates my invention in a general way but for a detailed illustration thereof the examples of froth flotation procedure are set forth below.

The procedure in performing the laboratory examples for manganese, tin, titanium, tungsten ores was of the same manipulation as follows:

500 grams of ore was ground wet as 67 percent solids by weight in a laboratory ball mill to pass 100 mesh sieve for manganese feed(psylomelane); 80 mesh sieve for cassiterite feed; and for scheelite and ilmenite the feed was sized to pass 120 standard mesh sieve. Transfering the sized flotation feed in the flotation machine, various amounts of said univalent metal double cyanide for reducing of the metal at the mineral surface were added in combination with adequate amounts of potassium cyanide and sulfuric acid. After this step the pulp of mineral slurry was conditioned for five minutes. After conditioning various amounts of olefine alcohols or propargyl carbinols were added for collecting purposes. The amounts of reductant, univalent metal double cyanides; olefine alcohols or propargyl carbinols are indicated in the accompaning table. Before skimming of the rougher concentrate the pulp of mineral slurry was conditioned and aerated for three to five minutes. The rougher concentrates were skimmed from about five to ten minutes, and afterwards cleaned with processed water.

The procedure in performing the beneficiation test for thorite, metahewettite (hydrous vanadate of lime), and samarskite was as follows:

The flotation test of sized sample was accomplished in a 50 grams flotation cell with 5 grams of thorite, or metahewettite, or samarskite respectively, and 45 grams of crystalline schist material with predominating feldspar. The addition of reagents was done dropwise. The recovery of thorite, or metahewettite, or samarskite was obtained by microscopic count.

| Ore treated | Activator pound per ton | Collector pound per ton | Assay of products Feed | Conc. | Recovery |
|---|---|---|---|---|---|
| Example 1 | di-Potassium iron tricyanide | Dodecenol glycol | Mn % | Mn % | Mn % |
| Psylomelane | 0.3 | 0.4 | 19.2 | 54.9 | 95.8 |
| Example 2 | di-Potassium manganese tricyanide | Octenol | Sn % | Sn % | Sn % |
| Cassiterite | 0.1 | 0.1 | 2.1 | 51.3 | 93.9 |
| Example 3 | di-Potassium nickel tricyanide | Octenol | $WO_3$% | $WO_3$% | $WO_3$% |
| Scheelite | 0.1 | 0.1 | 2.4 | 57.7 | 91.2 |
| Example 4 | di-Potassium manganese tricyanide | Dodecenol glycol | Ti % | Ti % | Ti % |
| Ilmenite | 0.4 | 0.4 | 8.0 | 30.1 | 94.1 |
| Example 5 | di-potassium manganese tricyanide | Octinol | — | — | 89.0 by microscopic count |
| Thorite | | | | | |
| Example 6 | di-Potassium manganese tricyanide | Octinol | — | — | 90.0 by microscopic count |
| Metahewettite | | | | | |
| Example 7 | di-Potassium manganese tricyanide | Octinol | — | — | 86.0 by microscopic count |
| Samarskite | | | | | |

I claim:

1. An improved method of beneficiating ores and minerals selected from the group of dioxides of manganese, tin, titanium, thorium, the vanadates and the wolframates by froth flotation process to produce a froth concentrate of desired metal value, which improvement comprises; effecting froth flotation of the ore by treating the comminuted ore of the mineral slurry with dipotassium manganese, or dipotassium iron, or dipotassium nickel tricyanide, which compounds act as reducing agents reducing said ores and minerals with the recited cyanides to a lower oxidizing state, and an addition of adequate amounts of potassium cyanide and sulfuric acid, followed by an effective amount of a collector selected from the group of olefine alcohols or propargyl carbinols, said alcohols and said carbinols have from 5 to 15 carbon atoms; and recovering a froth concentrate relatively rich in the desired metal value to leave the tailings relatively poor in the desired metal value.

* * * * *